US010968503B2

(12) United States Patent
Kubota et al.

(10) Patent No.: US 10,968,503 B2
(45) **Date of Patent: *Apr. 6, 2021**

(54) NON-ORIENTED ELECTRICAL STEEL SHEET

(71) Applicant: NIPPON STEEL CORPORATION, Tokyo (JP)

(72) Inventors: Takeshi Kubota, Tokyo (JP); Takashi Morohoshi, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/495,993

(22) PCT Filed: Jun. 2, 2017

(86) PCT No.: PCT/JP2017/020667

§ 371 (c)(1),
(2) Date: Sep. 20, 2019

(87) PCT Pub. No.: WO2018/220838

PCT Pub. Date: Dec. 6, 2018

(65) Prior Publication Data

US 2020/0017942 A1 Jan. 16, 2020

(51) Int. Cl.

| | |
|---|---|
| ***C22C 38/38*** | (2006.01) |
| ***C22C 38/20*** | (2006.01) |
| ***C22C 38/34*** | (2006.01) |
| ***C22C 38/06*** | (2006.01) |

(52) U.S. Cl.

CPC ..... *C22C 38/38* (2013.01); *C22C 38/06* (2013.01); *C22C 38/20* (2013.01); *C22C 38/34* (2013.01)

(58) Field of Classification Search

CPC ..... B22D 11/001; C21C 2007/0062; C21C 7/0006; C21C 7/0075; C21D 8/12; C21D 8/1211; C21D 8/1222; C21D 8/1233; C21D 8/1272; C21D 9/46; C22C 38/002; C22C 38/004; C22C 38/005; C22C 38/008; C22C 38/02; C22C 38/04; C22C 38/06; C22C 38/16; C22C 38/18; C22C 38/20; C22C 38/34; C22C 38/38; H01F 1/147

See application file for complete search history.

(56) References Cited

U.S. PATENT DOCUMENTS

| | | | |
|---|---|---|---|
| 5,482,107 | A | 1/1996 | Judd |
| 2004/0200548 | A1 | 10/2004 | Kurosaki et al. |
| 2009/0250145 | A1 | 10/2009 | Kurosaki et al. |
| 2017/0274432 | A1 | 9/2017 | Okubo et al. |

FOREIGN PATENT DOCUMENTS

| | | | | |
|---|---|---|---|---|
| CN | 101358272 | A | | 2/2009 |
| JP | 61-231120 | A | | 10/1986 |
| JP | 62-240714 | A | | 10/1987 |
| JP | 3-126845 | A | | 5/1991 |
| JP | 5-140648 | A | | 6/1993 |
| JP | 10-183309 | A | | 7/1998 |
| JP | 10183309 | A | * | 7/1998 |
| JP | 11-189850 | A | | 1/1999 |
| JP | 11189850 | A | * | 7/1999 |
| JP | 2001-271147 | A | | 10/2001 |
| JP | 2004-197217 | A | | 7/2004 |
| JP | 2004-323972 | A | | 11/2004 |
| JP | 2005-133175 | A | | 5/2005 |
| JP | 2005133175 | A | * | 5/2005 |
| JP | 2006-124809 | A | | 5/2006 |
| JP | 2008-127659 | A | | 6/2008 |
| JP | 2008-132534 | A | | 6/2008 |
| JP | 2008127659 | A | * | 6/2008 |
| JP | 2011-157603 | A | | 8/2011 |
| JP | 2012036474 | A | * | 2/2012 |
| JP | 2016-47942 | A | | 4/2016 |
| KR | 10-2012-0074009 | A | | 7/2012 |

OTHER PUBLICATIONS

International Preliminary Report on Patentability, dated Dec. 12, 2019, and English translation of the Written Opinion of the International Searching Authority, dated Aug. 29, 2017, (Forms PCT/IB/338, PCT/IB/373, and PCT/ISA/237) for International Application No. PCT/JP2017/020667.

International Search Report for PCT/JP2017/020667 dated Aug. 29, 2017.

Written Opinion of the International Searching Authority for PCT/JP2017/020667 (PCT/ISA/237) dated Aug. 29, 2017.

* cited by examiner

*Primary Examiner* — Jenny R Wu

(74) *Attorney, Agent, or Firm* — Birch, Stewart, Kolasch & Birch, LLP

(57) ABSTRACT

When a Si content (mass %) is set to [Si], an Al content (mass %) is set to [Al], and a Mn content (mass %) is set to [Mn], a parameter Q represented by "Q=[Si]+2[Al]−[Mn]" is 2.00 or more, the total mass of S contained in sulfides or oxysulfides of Mg, Ca, Sr, Ba, Ce, La, Nd, Pr, Zn, or Cd is 10% or more of the total mass of S contained in a non-oriented electrical steel sheet, a {100} crystal orientation intensity is 3.0 or more, a thickness is 0.15 mm to 0.30 mm, and an average crystal grain diameter is 65 μm to 100 μm.

4 Claims, No Drawings

NON-ORIENTED ELECTRICAL STEEL SHEET

TECHNICAL FIELD

The present invention relates to a non-oriented electrical steel sheet.

BACKGROUND ART

A non-oriented electrical steel sheet is used for, for example, an iron core of a motor, and the non-oriented electrical steel sheet is required to have excellent magnetic properties, for example, a low core loss and a high magnetic flux density, in all directions parallel to its sheet surface (sometimes referred to as "all directions within a sheet surface", hereinafter). Although various techniques have been proposed so far, it is difficult to obtain sufficient magnetic properties in all directions within a sheet surface. For example, even if it is possible to obtain sufficient magnetic properties in a certain specific direction within a sheet surface, it is sometimes impossible to obtain sufficient magnetic properties in the other directions.

CITATION LIST

Patent Literature

Patent Literature 1: Japanese Laid-open Patent Publication No. 3-126845

Patent Literature 2: Japanese Laid-open Patent Publication No. 2006-124809

Patent Literature 3: Japanese Laid-open Patent Publication No. 61-231120

Patent Literature 4: Japanese Laid-open Patent Publication No. 2004-197217

Patent Literature 5: Japanese Laid-open Patent Publication No. 5-140648

Patent Literature 6: Japanese Laid-open Patent Publication No. 2008-132534

Patent Literature 7: Japanese Laid-open Patent Publication No. 2004-323972

Patent Literature 8: Japanese Laid-open Patent Publication No. 62-240714

Patent Literature 9: Japanese Laid-open Patent Publication No. 2011-157603

Patent Literature 10: Japanese Laid-open Patent Publication No. 2008-127659

SUMMARY OF INVENTION

Technical Problem

The present invention has an object to provide a non-oriented electrical steel sheet capable of obtaining excellent magnetic properties in all directions within a sheet surface.

Solution to Problem

The present inventors conducted earnest studies to solve the above-described problems. As a result of this, it was clarified that it is important to set proper chemical composition, thickness, and average crystal grain diameter. It was also clarified that for manufacture of a non-oriented electrical steel sheet as described above, it is important to control a columnar crystal percentage and an average crystal grain diameter during casting or rapid solidification of molten steel at a time of obtaining a steel strip to be subjected to cold rolling such as a hot-rolled steel strip, control a reduction ratio in cold rolling, and control a sheet passage tension and a cooling rate during finish annealing.

The present inventors further conducted earnest studies repeatedly based on such findings, and consequently, they came up with various examples of the invention to be described below.

(1)

A non-oriented electrical steel sheet is characterized in that it includes a chemical composition represented by: in mass %, C: 0.0030% or less; Si: 2.00% to 4.00%; Al: 0.10% to 3.00%; Mn: 0.10% to 2.00%; S: 0.0030% or less; one kind or more selected from a group consisting of Mg, Ca, Sr, Ba, Ce, La, Nd, Pr, Zn, and Cd: 0.0003% or more and less than 0.0015% in total; a parameter Q represented by an equation 1 when the Si content (mass %) is set to [Si], the Al content (mass %) is set to [Al], and the Mn content (mass %) is set to [Mn]: 2.00 or more; Sn: 0.00% to 0.40%; Cu: 0.0% to 1.0%; Cr: 0.0% to 10.0%; and a balance: Fe and impurities, in which: the total mass of S contained in sulfides or oxysulfides of Mg, Ca, Sr, Ba, Ce, La, Nd, Pr, Zn, or Cd is 10% or more of the total mass of S contained in the non-oriented electrical steel sheet; a {100} crystal orientation intensity is 3.0 or more; a thickness is 0.15 mm to 0.30 mm; and an average crystal grain diameter is 65 μm to 100 μm.

$$Q=[Si]+2[Al]-[Mn] \quad \text{(Equation 1)}$$

(2)

The non-oriented electrical steel sheet described in (1) is characterized in that in the chemical composition, Sn: 0.02% to 0.40% or Cu: 0.1% to 1.0% is satisfied, or both of them are satisfied.

(3)

The non-oriented electrical steel sheet described in (1) or (2) is characterized in that in the chemical composition, Cr: 0.2% to 10.0% is satisfied.

Advantageous Effects of Invention

According to the present invention, since a chemical composition, a thickness, and an average crystal grain diameter are proper, it is possible to obtain excellent magnetic properties in all directions within a sheet surface.

DESCRIPTION OF EMBODIMENTS

Hereinafter, embodiments of the present invention will be described in detail.

First, a chemical composition of a non-oriented electrical steel sheet according to an embodiment of the present invention and molten steel used for manufacturing the non-oriented electrical steel sheet will be described. Although details will be described later, the non-oriented electrical steel sheet according to the embodiment of the present invention is manufactured through casting of molten steel and hot rolling, or rapid solidification of molten steel, cold rolling, and finish annealing and the like. Therefore, the chemical composition of the non-oriented electrical steel sheet and the molten steel takes not only properties of the non-oriented electrical steel sheet but also the processing of the above into consideration. In the following explanation, "%" being a unit of a content of each element contained in the non-oriented electrical steel sheet or the molten steel means "mass %" unless otherwise noted. The non-oriented electrical steel sheet according to the present embodiment has a chemical composition represented by: C: 0.0030% or less; Si: 2.00% to 4.00%; Al: 0.10% to 3.00%; Mn: 0.10% to 2.00%; S: 0.0030% or less; one kind or more selected from a group consisting of Mg, Ca, Sr, Ba, Ce, La, Nd, Pr, Zn, and Cd: 0.0003% or more and less than 0.0015% in total; a parameter Q represented by an equation 1 when the Si content (mass %) is set to [Si], the Al content (mass %) is set to [Al], and the Mn content (mass %) is set to [Mn]: 2.00 or more; Sn: 0.00% to 0.40%; Cu: 0.0% to 1.0%; Cr: 0.0% to 10.0%; and a balance: Fe and impurities. As the impurities, one included in a raw material of an ore, scrap or the like, and one included in a manufacturing process can be exemplified.

$$Q=[Si]+2[Al]-[Mn] \quad \text{(Equation 1)}$$

(C: 0.0030% or Less)

C increases a core loss and causes magnetic aging. Therefore, the C content is preferably as low as possible. Such a phenomenon is significantly observed when the C content exceeds 0.0030%. For this reason, the C content is set to 0.0030% or less. The reduction in the C content also contributes to uniform improvement of magnetic properties in all directions within a sheet surface.

(Si: 2.00% to 4.00%)

Si increases an electrical resistance to reduce an eddy current loss, to thereby reduce a core loss, and Si increase a yield ratio, to thereby improve punchability with respect to an iron core. When the Si content is less than 2.00%, these operations and effects cannot be sufficiently obtained. Therefore, the Si content is set to 2.00% or more. On the other hand, when the Si content exceeds 4.00%, there is a case where a magnetic flux density is lowered, the punchability is lowered due to an excessive increase in hardness, and it becomes difficult to perform cold rolling. Therefore, the Si content is set to 4.00% or less.

(Al: 0.10% to 3.00%)

Al increases an electrical resistance to reduce an eddy current loss, to thereby reduce a core loss. Al also contributes to improvement of a relative magnitude of a magnetic flux density B50 with respect to a saturation magnetic flux density. Here, the magnetic flux density B50 indicates a magnetic flux density in a magnetic field of 5000 A/m. When the Al content is less than 0.10%, these operations and effects cannot be sufficiently obtained. Therefore, the Al content is set to 0.10% or more. On the other hand, when the Al content exceeds 3.00%, there is a case where the magnetic flux density is lowered, and the yield ratio is lowered to reduce the punchability. Therefore, the Al content is set to 3.00% or less.

(Mn: 0.10% to 2.00%)

Mn increases an electrical resistance to reduce an eddy current loss, to thereby reduce a core loss. When Mn is contained, a texture obtained in primary recrystallization is likely to be one in which a crystal whose plane parallel to a sheet surface is a {100} plane (sometimes referred to as a "{100} crystal", hereinafter) is developed. The {100} crystal is a crystal suitable for uniform improvement of magnetic properties in all directions within a sheet surface. Further, the higher the Mn content, the higher a precipitation temperature of MnS, which increases a size of MnS to be precipitated. For this reason, as the Mn content becomes higher, fine MnS having a grain diameter of about 100 nm and inhibiting recrystallization and growth of crystal grains in finish annealing is more difficult to be precipitated. When the Mn content is less than 0.10%, these operations and effects cannot be sufficiently obtained. Therefore, the Mn content is set to 0.10% or more. On the other hand, when the Mn content exceeds 2.00%, crystal grains do not sufficiently grow in the finish annealing, which results in increasing a core loss. Therefore, the Mn content is set to 2.00% or less.

(S: 0.0030% or Less)

S is not an essential element but is contained in steel as an impurity, for example. S inhibits recrystallization and growth of crystal grains in finish annealing because of precipitation of fine MnS. Therefore, the S content is preferably as low as possible. The increase in core loss as above is significantly observed when the S content exceeds 0.0030%. For this reason, the S content is set to 0.0030% or less.

(One Kind or More Selected from Group consisting of Mg, Ca, Sr, Ba, Ce, La, Nd, Pr, Zn, and Cd: 0.0003% or More and Less than 0.0015% in Total)

Mg, Ca, Sr, Ba, Ce, La, Nd, Pr, Zn, and Cd react with S in molten steel during casting or rapid solidification of the molten steel to generate precipitates of sulfides or oxysulfides, or both of them. Hereinafter, Mg, Ca, Sr, Ba, Ce, La, Nd, Pr, Zn, and Cd are sometimes collectively referred to as "coarse precipitate generating elements". A grain diameter of a precipitate of the coarse precipitate generating element is about 1 μm to 2 μm, which is far larger than a grain diameter (about 100 nm) of a fine precipitate of MnS, TiN, AlN, or the like. For this reason, these fine precipitates adhere to the precipitate of the coarse precipitate generating element, which makes it difficult to inhibit the recrystallization and the growth of crystal grains in the finish annealing. When the content of the coarse precipitate generating elements is less than 0.0003% in total, these operations and effects cannot be stably obtained. Therefore, the content of the coarse precipitate generating elements is set to 0.0003% or more in total. On the other hand, when the content of the coarse precipitate generating elements is equal to or more than 0.0015% in total, the precipitates of the sulfides or the oxysulfides, or both of them sometimes inhibit the recrystallization and the growth of crystal grains in the finish annealing. Therefore, the content of the coarse precipitate generating elements is set to less than 0.0015% in total.

(Parameter Q: 2.00 or More)

When the parameter Q represented by the equation 1 is less than 2.00, ferrite-austenite transformation (α-γ transformation) may be caused, which results in breaking once-generated columnar crystals due to the α-γ transformation and reducing an average crystal grain diameter during casting or rapid solidification of molten steel. Further, the α-γ transformation is sometimes caused during the finish annealing. For this reason, when the parameter Q is less than 2.00, it is not possible to obtain desired magnetic properties. Therefore, the parameter Q is set to 2.00 or more.

Sn, Cu, and Cr are not essential elements but are optional elements which may be appropriately contained, up to a predetermined amount as a limit, in the non-oriented electrical steel sheet.

(Sn: 0.00% to 0.40%, Cu: 0.0% to 1.0%)

Sn and Cu develop crystals suitable for improving the magnetic properties in primary recrystallization. For this reason, when Sn or Cu, or both of them are contained, it is likely to obtain, in primary recrystallization, a texture in which the {100} crystal suitable for uniform improvement of magnetic properties in all directions within a sheet surface is developed. Sn suppresses oxidation and nitriding of a surface of a steel sheet during finish annealing and suppresses a size variation of crystal grains. Therefore, Sn or Cu, or both of them may be contained. In order to sufficiently obtain these operations and effects, it is preferable that Sn: 0.02% or more or Cu: 0.1% or more is satisfied, or both of them are satisfied. On the other hand, when Sn exceeds 0.40%, the above operations and effects are saturated, which unnecessarily increases a cost and which suppresses growth of crystal grains in finish annealing. Therefore, the Sn content is set to 0.40% or less. When the Cu content exceeds 1.0%, a steel sheet is embrittled, resulting in that it becomes difficult to perform hot rolling and cold rolling, and sheet passage in an annealing line in the finish annealing becomes difficult to be performed. Therefore, the Cu content is set to 1.0% or less.

(Cr: 0.0% to 10.0%)

Cr reduces a high-frequency core loss. The reduction in high-frequency core loss contributes to high-speed rotation of a rotary machine, and the high-speed rotation contributes to a size reduction and high efficiency of the rotary machine. Cr increases an electrical resistance to reduce an eddy current loss, to thereby reduce a core loss such as a high-frequency core loss. Cr lowers stress sensitivity, and it also contributes to reduction of lowering of magnetic properties in accordance with a compressive stress introduced when forming an iron core and reduction of lowering of magnetic properties in accordance with a compressive stress which is acted during high-speed rotation. Therefore, Cr may be contained. In order to sufficiently obtain these operations and effects, it is preferable to set that Cr: 0.2% or more. On the other hand, when the Cr content exceeds 10.0%, the magnetic flux density is lowered and a cost is increased. Therefore, the Cr content is set to 10.0% or less.

Next, a form of S in the non-oriented electrical steel sheet according to the embodiment of the present invention will be described. In the non-oriented electrical steel sheet according to the present embodiment, the total mass of S contained in the sulfides or the oxysulfides of the coarse precipitate generating element is 10% or more of the total mass of S contained in the non-oriented electrical steel sheet. As described above, the coarse precipitate generating element reacts with S in molten steel during casting or rapid solidification of the molten steel to generate precipitates of sulfides or oxysulfides, or both of them. Therefore, when the ratio of the total mass of S contained in the sulfides or the oxysulfides of the coarse precipitate generating element to the total mass of S contained in the non-oriented electrical steel sheet is high, this means that a sufficient amount of the coarse precipitate generating element is contained in the non-oriented electrical steel sheet, and fine precipitates of MnS or the like effectively adhere to the precipitate of the coarse precipitate generating element. For this reason, as the above ratio becomes higher, the recrystallization and the growth of crystal grains in the finish annealing are more facilitated, resulting in that excellent magnetic properties are obtained. Further, when the above ratio is less than 10%, the recrystallization and the growth of crystal grains in the finish annealing are not sufficient, and it is not possible to obtain excellent magnetic properties.

Next, the texture of the non-oriented electrical steel sheet according to the embodiment of the present invention will be described. In the non-oriented electrical steel sheet according to the present embodiment, a {100} crystal orientation intensity is 3.0 or more. When the {100} crystal orientation intensity is less than 3.0, the reduction in the magnetic flux density and the increase in the core loss are caused, and the variation of the magnetic properties between directions parallel to the sheet surface is caused. The {100} crystal orientation intensity can be measured by an X-ray diffraction method or an electron backscatter diffraction (EBSD) method. A reflection angle or the like from a sample of X-ray and electron beam differs for each crystal orientation, so that a crystal orientation intensity can be determined from a reflection intensity or the like of the sample, on the basis of a random orientation sample.

Next, an average crystal grain diameter of the non-oriented electrical steel sheet according to the embodiment of the present invention will be explained. The average crystal grain diameter of the non-oriented electrical steel sheet according to the present embodiment is 65 μm to 100 μm. When the average crystal grain diameter is less than 65 μm or when it exceeds 100 μm, a core loss W10/800 is high. Here, the core loss W10/800 is a core loss at a magnetic flux density of 1.0 T and a frequency of 800 Hz.

Next, a thickness of the non-oriented electrical steel sheet according to the embodiment of the present invention will be explained. The thickness of the non-oriented electrical steel sheet according to the present embodiment is, for example, 0.15 mm or more and 0.30 mm or less. When the thickness exceeds 0.30 mm, an excellent high-frequency core loss cannot be obtained. Therefore, the thickness is set to 0.30 mm or less. When the thickness is less than 0.15 mm, magnetic properties at the surface of the non-oriented electrical steel sheet with low stability become more dominant than magnetic properties at the inside of the non-oriented electrical steel sheet with high stability. Further, when the thickness is less than 0.15 mm, the sheet passage in the annealing line in the finish annealing becomes difficult to be performed, and the number of non-oriented electrical steel sheets required for an iron core with a certain size is increased to cause a reduction in productivity and an increase in manufacturing cost due to an increase in man-hour. Therefore, the thickness is set to 0.15 mm or more.

Next, magnetic properties of the non-oriented electrical steel sheet according to the embodiment of the present invention will be explained. The non-oriented electrical steel sheet according to the present embodiment can exhibit magnetic properties represented by the magnetic flux density B50: 1.67 T or more and the core loss W10/800: $30\times[0.45+0.55\times\{0.5\times(t/0.20)+0.5\times(t/0.20)^2\}]$ W/kg or less when the thickness of the non-oriented electrical steel sheet is represented as t (mm) in ring magnetometry, for example.

In the ring magnetometry, a ring-shaped sample taken from the non-oriented electrical steel sheet, for example, a ring-shaped sample having an outside diameter of 5 inches (12.70 cm) and an inside diameter of 4 inches (10.16 cm) is excited to make a magnetic flux flow through the whole circumference of the sample. The magnetic properties obtained by the ring magnetometry reflect the structure in all directions within the sheet surface.

Next, a first manufacturing method of the non-oriented electrical steel sheet according to the embodiment will be explained. In this first manufacturing method, casting of molten steel, hot rolling, cold rolling, finish annealing, and so on are performed.

In the casting of molten steel and the hot rolling, the molten steel having the above-described chemical composition is cast to produce a steel ingot such as a slab, and the steel ingot is subjected to hot rolling to obtain a steel strip in which a percentage of hot-rolled crystal structure in which a columnar crystal in the steel ingot such as the slab is set to a starting cast structure is 80% or more in an area fraction and an average crystal grain diameter is 0.1 mm or more.

The columnar crystal has a {100}<0vw> texture which is desirable for uniform improvement of the magnetic properties of the non-oriented electrical steel sheet, in particular, the magnetic properties in all directions within a sheet surface. The {100}<0vw> texture is a texture in which a crystal whose plane parallel to the sheet surface is a {100} plane and whose rolling direction is in a <0vw> orientation is developed (v and w are arbitrary real numbers (except for a case where both of v and w are 0)). When the percentage of the columnar crystals is less than 80%, it is not possible to obtain the texture in which the {100} crystal is developed by the finish annealing. Therefore, the percentage of the columnar crystals is set to 80% or more. The percentage of the columnar crystals can be specified through a microscopic observation. In the first manufacturing method, in order to set the percentage of the columnar crystals to 80% or more, for example, a temperature difference between one surface and the other surface of a cast slab during solidification is set to 40° C. or more. This temperature difference can be controlled by a cooling structure of a mold, a material, a mold taper, a mold flux, or the like. When molten steel is cast under such a condition in which the percentage of the columnar crystals becomes 80% or more, sulfides or oxysulfides, or both of them of Mg, Ca, Sr, Ba, Ce, La, Nd, Pr, Zn, or Cd are easily generated, which results in suppressing the generation of fine sulfides such as MnS.

The smaller the average crystal grain diameter of the steel strip, the larger the number of crystal grains and the wider the area of the crystal grain boundary. In the recrystallization in the finish annealing, crystals are grown from the inside of the crystal grain and from the crystal grain boundary, in which the crystal grown from the inside of the crystal grain is the {100} crystal which is desirable for the magnetic properties, and on the contrary, the crystal grown from the crystal grain boundary is a crystal which is not desirable for the magnetic properties, such as a {111}<112> crystal. Therefore, as the average crystal grain diameter of the steel strip becomes larger, the {100} crystal which is desirable for the magnetic properties is more likely to develop in the finish annealing, and when the average crystal grain diameter of the steel strip is 0.1 mm or more, in particular, excellent magnetic properties are likely to be obtained. Therefore, the average crystal grain diameter of the steel strip is set to 0.1 mm or more. The average crystal grain diameter of the steel strip can be adjusted by a starting temperature of the hot rolling, a coiling temperature, and the like. When the starting temperature is set to 900° C. or less and the coiling temperature is set to 650° C. or less, a crystal grain included in the steel strip becomes a crystal grain which is non-recrystallized and extended in a rolling direction, and thus it is possible to obtain a steel strip whose average crystal grain diameter is 0.1 mm or more.

It is preferable that the coarse precipitate generating element is previously put in a bottom of a last pot before casting in a steelmaking process, and molten steel containing elements other than the coarse precipitate generating element is poured into the pot, to thereby make the coarse precipitate generating element dissolve in the molten steel. This can make it difficult to cause scattering of the coarse precipitate generating element from the molten steel, and further, it is possible to facilitate the reaction between the coarse precipitate generating element and S. The last pot before casting in the steelmaking process is, for example, a pot right above a tundish of a continuous casting machine.

When a reduction ratio in the cold rolling is set to greater than 90%, a texture which inhibits the improvement of the magnetic properties, for example, the {111}<112> texture is likely to develop when performing the finish annealing. Therefore, the reduction ratio in the cold rolling is set to 90% or less. When the reduction ratio in the cold rolling is set to less than 40%, it becomes difficult to secure the accuracy of thickness and the flatness of the non-oriented electrical steel sheet in some cases. Therefore, the reduction ratio in the cold rolling is preferably set to 40% or more.

By the finish annealing, the primary recrystallization and the growth of crystal grains are caused, to thereby make the average crystal grain diameter to be 65 μm to 100 μm. By this finish annealing, the texture in which the {100} crystal suitable for uniform improvement of magnetic properties in all directions within a sheet surface is developed, can be obtained. In the finish annealing, for example, a retention temperature is set to 900° C. or more and 1000° C. or less, and a retention time is set to 10 seconds or more and 60 seconds or less.

When a sheet passage tension in the finish annealing is set to greater than 3 MPa, an elastic strain having anisotropy is likely to remain in the non-oriented electrical steel sheet. The elastic strain having anisotropy deforms the texture, so that even if the texture in which the {100} crystal is developed is already obtained, the texture is deformed, and the uniformity of the magnetic properties within a sheet surface is lowered. Therefore, the sheet passage tension in the finish annealing is set to 3 MPa or less. Also when a cooling rate between 950° C. and 700° C. in the finish annealing is set to greater than 1° C./second, the elastic strain having anisotropy is likely to remain in the non-oriented electrical steel sheet. Therefore, the cooling rate between 950° C. and 700° C. in the finish annealing is set to 1° C./second or less.

The non-oriented electrical steel sheet according to the present embodiment can be manufactured in a manner as described above. It is also possible that after the finish annealing, an insulating coating film is formed through coating and baking.

Next, a second manufacturing method of the non-oriented electrical steel sheet according to the embodiment will be explained. In this second manufacturing method, rapid solidification of molten steel, cold rolling, finish annealing, and so on are performed.

In the rapid solidification of molten steel, the molten steel having the above-described chemical composition is subjected to rapid solidification on a traveling cooling body surface, to thereby obtain a steel strip in which a percentage of the columnar crystals is 80% or more in an area fraction and the average crystal grain diameter is 0.1 mm or more.

In order to set the percentage of the columnar crystals to 80% or more in the second manufacturing method, for example, a temperature of the molten steel when being poured into the traveling cooling body surface is set to be higher than a solidification temperature by 25° C. or more. In particular, when the temperature of the molten steel is set to be higher than the solidification temperature by 40° C. or more, the percentage of the columnar crystals can be set to almost 100%. When the molten steel is solidified under such a condition in which the percentage of the columnar crystals becomes 80% or more, sulfides or oxysulfides, or both of them of Mg, Ca, Sr, Ba, Ce, La, Nd, Pr, Zn, or Cd are easily generated, which results in suppressing the generation of fine sulfides such as MnS.

Also in the second manufacturing method, the average crystal grain diameter of the steel strip is set to 0.1 mm or more. The average crystal grain diameter of the steel strip can be adjusted by the temperature of the molten steel when being poured into the surface of the cooling body, the cooling rate at the surface of the cooling body, and the like during the rapid solidification.

When performing the rapid solidification, it is preferable that the coarse precipitate generating element is previously put in a bottom of a last pot before casting in a steelmaking process, and molten steel containing elements other than the coarse precipitate generating element is poured into the pot, to thereby make the coarse precipitate generating element dissolve in the molten steel. This can make it difficult to cause scattering of the coarse precipitate generating element from the molten steel, and further, it is possible to facilitate the reaction between the coarse precipitate generating element and S. The last pot before casting in the steelmaking process is, for example, a pot right above a tundish of a casting machine which is made to perform the rapid solidification.

The cold rolling and the finish annealing may be performed under conditions similar to those of the first manufacturing method.

The non-oriented electrical steel sheet according to the present embodiment can be manufactured in a manner as described above. It is also possible that after the finish annealing, an insulating coating film is formed through coating and baking.

The non-oriented electrical steel sheet according to the present embodiment as described above exhibits uniform and excellent magnetic properties in all directions within a sheet surface, and is used for an iron core of an electric equipment such as a rotary machine, medium and small sized transformers, and an electrical component. Further, the non-oriented electrical steel sheet according to the present embodiment can also contribute to high efficiency and a reduction in size of a rotary machine.

The preferred embodiments of the present invention have been described above in detail, but, the present invention is not limited to such examples. It is apparent that a person having common knowledge in the technical field to which the present invention belongs is able to devise various variation or modification examples within the range of technical ideas described in the claims, and it should be understood that such examples belong to the technical scope of the present invention as a matter of course.

Examples

Next, the non-oriented electrical steel sheet according to the embodiment of the present invention will be concretely explained while showing Examples. Examples to be shown below are only examples of the non-oriented electrical steel sheet according to the embodiment of the present invention, and the non-oriented electrical steel sheet according to the present invention is not limited to the examples to be described below.

(First Test)

In a first test, molten steels having chemical compositions presented in Table 1 were cast to produce slabs, and the slabs were subjected to hot rolling to obtain steel strips. A blank column in Table 1 indicates that a content of an element in that column was less than a detection limit, and a balance is composed of Fe and impurities. An underline in Table 1 indicates that the underlined numeric value is out of the range of the present invention. Next, the steel strips were subjected to cold rolling and finish annealing to produce various non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are presented in Table 2. An underline in Table 2 indicates that the underlined numeric value is out of the range of the present invention.

[Table 1]

TABLE 1

| SYMBOL OF STEEL | CHEMICAL COMPOSITION (MASS %) | | | | | | | | |
|---|---|---|---|---|---|---|---|---|---|
| | C | Si | Al | Mn | S | Mg | Ca | Sr | Ba |
| A1 | 0.0014 | 1.31 | 0.54 | 0.20 | 0.0022 | | | 0.0004 | |
| B1 | 0.0013 | 2.78 | 0.90 | 0.18 | 0.0020 | | | 0.0009 | |
| C1 | 0.0021 | 2.75 | 0.88 | 0.17 | 0.0019 | | | | 0.0010 |
| D1 | 0.0025 | 2.77 | 0.89 | 0.18 | 0.0023 | | | | 0.0009 |
| E1 | 0.0018 | 2.69 | 0.94 | 0.22 | 0.0017 | | | | |
| F1 | 0.0019 | 2.78 | 0.90 | 0.17 | 0.0016 | | | | |
| G1 | 0.0011 | 2.75 | 0.88 | 0.26 | 0.0035 | | 0.0008 | | |
| H1 | 0.0021 | 2.72 | 0.89 | 0.21 | 0.0020 | | 0.0002 | | |
| I1 | 0.0022 | 2.80 | 0.94 | 0.19 | 0.0018 | | 0.0017 | | |
| J1 | 0.0020 | 1.22 | 0.89 | 1.18 | 0.0027 | 0.0007 | | | |
| K1 | 0.0018 | 2.78 | 0.94 | 0.24 | 0.0022 | 0.0005 | | | |
| L1 | 0.0016 | 2.75 | 0.87 | 0.21 | 0.0019 | | 0.0011 | | |
| M1 | 0.0016 | 2.81 | 0.90 | 0.22 | 0.0021 | | | 0.0009 | |
| N1 | 0.0020 | 2.77 | 0.89 | 0.22 | 0.0018 | | | | 0.0008 |
| O1 | 0.0019 | 2.78 | 0.91 | 0.21 | 0.0016 | | | | |
| P1 | 0.0017 | 2.77 | 0.94 | 0.24 | 0.0024 | | | | |
| Q1 | 0.0021 | 2.75 | 0.92 | 0.21 | 0.0022 | | | | |
| R1 | 0.0024 | 2.76 | 0.88 | 0.22 | 0.0015 | | | | |
| S1 | 0.0022 | 2.83 | 0.93 | 0.24 | 0.0018 | | | | |
| T1 | 0.0023 | 2.89 | 0.85 | 0.20 | 0.0023 | | | | |

TABLE 1-continued

| SYMBOL OF STEEL | CHEMICAL COMPOSITION (MASS %) | | | | | | | |
|---|---|---|---|---|---|---|---|---|
| | Ce | Zn | Cd | Sn | Cu | Cr | TOTAL AMOUNT OF COARSE PRECIPITATE GENERATING ELEMENT | PARAMETER Q |
| A1 | | | | | | | 0.0004 | 2.19 |
| B1 | | | | | | | 0.0009 | 4.40 |
| C1 | | | | | | | 0.0010 | 4.34 |
| D1 | | | | | | | 0.0009 | 4.37 |
| E1 | 0.0013 | | | | | | 0.0013 | 4.35 |
| F1 | | 0.0008 | | | | | 0.0008 | 4.41 |
| G1 | | | | | | | 0.0008 | 4.25 |
| H1 | | | | | | | 0.0002 | 4.29 |
| I1 | | | | | | | 0.0017 | 4.49 |
| J1 | | | | | | | 0.0007 | 1.82 |
| K1 | | | | | | | 0.0005 | 4.42 |
| L1 | | | | | | | 0.0011 | 4.28 |
| M1 | | | | | | | 0.0009 | 4.39 |
| N1 | | | | | | | 0.0003 | 4.33 |
| O1 | 0.0012 | | | | | | 0.0012 | 4.39 |
| P1 | | 0.0013 | | | | | 0.0013 | 4.41 |
| Q1 | | | 0.0009 | | | | 0.0009 | 4.38 |
| R1 | | | 0.0010 | 0.14 | | | 0.0010 | 4.30 |
| S1 | | | 0.0007 | | 0.32 | | 0.0007 | 4.45 |
| T1 | | | 0.0011 | | | 6.41 | 0.0011 | 4.39 |

30

[Table 2]

TABLE 2

| SAMPLE No. | SYMBOL OF STEEL | RATIO $R_S$ (%) | INTENSITY I | THICKNESS t (mm) | AVERAGE CRYSTAL GRAIN DIAMETER r (μm) | REMARKS |
|---|---|---|---|---|---|---|
| 1 | A1 | 8 | 4.6 | 0.20 | 78 | COMPARATIVE EXAMPLE |
| 2 | B1 | 18 | 2.5 | 0.20 | 79 | COMPARATIVE EXAMPLE |
| 3 | C1 | 14 | 4.8 | 0.13 | 81 | COMPARATIVE EXAMPLE |
| 4 | D1 | 11 | 4.3 | 0.32 | 80 | COMPARATIVE EXAMPLE |
| 5 | E1 | 15 | 4.5 | 0.20 | 59 | COMPARATIVE EXAMPLE |
| 6 | F1 | 22 | 4.8 | 0.20 | 108 | COMPARATIVE EXAMPLE |
| 7 | G1 | 18 | 5.0 | 0.20 | 79 | COMPARATIVE EXAMPLE |
| 8 | H1 | 7 | 4.2 | 0.20 | 78 | COMPARATIVE EXAMPLE |
| 9 | I1 | 58 | 4.4 | 0.20 | 77 | COMPARATIVE EXAMPLE |
| 10 | J1 | 35 | 4.3 | 0.20 | 88 | COMPARATIVE EXAMPLE |
| 11 | K1 | 30 | 4.1 | 0.20 | 76 | INVENTION EXAMPLE |
| 12 | L1 | 42 | 5.1 | 0.20 | 75 | INVENTION EXAMPLE |
| 13 | M1 | 18 | 4.8 | 0.20 | 77 | INVENTION EXAMPLE |
| 14 | N1 | 13 | 5.2 | 0.20 | 80 | INVENTION EXAMPLE |
| 15 | O1 | 12 | 4.3 | 0.20 | 73 | INVENTION EXAMPLE |
| 16 | P1 | 28 | 4.4 | 0.20 | 75 | INVENTION EXAMPLE |
| 17 | Q1 | 13 | 4.9 | 0.20 | 76 | INVENTION EXAMPLE |
| 18 | R1 | 22 | 4.5 | 0.20 | 78 | INVENTION EXAMPLE |
| 19 | S1 | 13 | 4.9 | 0.20 | 82 | INVENTION EXAMPLE |
| 20 | T1 | 16 | 5.1 | 0.20 | 90 | INVENTION EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 3. An underline in Table 3 indicates that the underlined numeric value is not within the desired range. Specifically, an underline in a column of core loss W10/800 indicates that the underlined value is equal to or more than an evaluation criterion W0 (W/kg) represented by an equation 2.

$$W0=30\times[0.45+0.55\times\{0.5\times(t/0.20)+0.5\times(t/0.20)^2\}] \quad \text{(Equation 2)}$$

[Table 3]

TABLE 3

| SAMPLE No. | W0 (W/kg) | W10/800 (W/kg) | B50 (T) | REMARKS |
|---|---|---|---|---|
| 1 | 30.0 | 34.5 | 1.74 | COMPARATIVE EXAMPLE |
| 2 | 30.0 | 32.0 | 1.67 | COMPARATIVE EXAMPLE |
| 3 | 22.3 | 25.3 | 1.67 | COMPARATIVE EXAMPLE |
| 4 | 47.8 | 49.9 | 1.71 | COMPARATIVE EXAMPLE |
| 5 | 30.0 | 33.1 | 1.69 | COMPARATIVE EXAMPLE |
| 6 | 30.0 | 31.8 | 1.68 | COMPARATIVE EXAMPLE |
| 7 | 30.0 | 34.2 | 1.68 | COMPARATIVE EXAMPLE |
| 8 | 30.0 | 37.4 | 1.67 | COMPARATIVE EXAMPLE |
| 9 | 30.0 | 35.6 | 1.68 | COMPARATIVE EXAMPLE |
| 10 | 30.0 | 33.8 | 1.71 | COMPARATIVE EXAMPLE |
| 11 | 30.0 | 24.6 | 1.72 | INVENTION EXAMPLE |
| 12 | 30.0 | 25.3 | 1.71 | INVENTION EXAMPLE |
| 13 | 30.0 | 24.2 | 1.72 | INVENTION EXAMPLE |
| 14 | 30.0 | 24.5 | 1.73 | INVENTION EXAMPLE |
| 15 | 30.0 | 23.9 | 1.72 | INVENTION EXAMPLE |
| 16 | 30.0 | 24.8 | 1.71 | INVENTION EXAMPLE |
| 17 | 30.0 | 24.1 | 1.71 | INVENTION EXAMPLE |
| 18 | 30.0 | 23.4 | 1.73 | INVENTION EXAMPLE |
| 19 | 30.0 | 22.9 | 1.73 | INVENTION EXAMPLE |
| 20 | 30.0 | 17.6 | 1.68 | INVENTION EXAMPLE |

As presented in Table 3, in each of a sample No. 11 to a sample No. 20, the chemical composition is within the range of the present invention, and the ratio $R_S$, the {100} crystal orientation intensity I, the thickness t, and the average crystal grain diameter r are within the range of the present invention, so that good results were obtained in the ring magnetometry.

In the sample No. 1, the ratio $R_S$ was excessively low, and thus the core loss W10/800 was large. In the sample No. 2, the {100} crystal orientation intensity I was excessively low, and thus the core loss W10/800 was large. In the sample No. 3, the thickness t was excessively small, and thus the core loss W10/800 was large. In the sample No. 4, the thickness t was excessively large, and thus the core loss W10/800 was large. In the sample No. 5, the average crystal grain diameter r was excessively small, and thus the core loss W10/800 was large. In the sample No. 6, the average crystal grain diameter r was excessively large, and thus the core loss W10/800 was large. In the sample No. 7, the S content was excessively high, and thus the core loss W10/800 was large. In the sample No. 8, the total content of the coarse precipitate generating element was excessively low, and thus the core loss W10/800 was large. In the sample No. 9, the total content of the coarse precipitate generating element was excessively high, and thus the core loss W10/800 was large. In the sample No. 10, the parameter Q was excessively small, and thus the core loss W10/800 was large.

(Second Test)

In a second test, molten steels each containing, in mass %, C: 0.0023%, Si: 3.46%, Al: 0.63%, Mn: 0.20%, S: 0.0003%, and Pr: 0.0008%, and a balance composed of Fe and impurities, were cast to produce slabs, and the slabs were subjected to hot rolling to obtain steel strips each having a thickness of 1.4 mm. When performing the casting, a temperature difference between two surfaces of a cast slab was adjusted to change a percentage of columnar crystals in the slab being a starting material of the steel strip, and a starting temperature in the hot rolling and a coiling temperature were adjusted to change an average crystal grain diameter of the steel strip. Table 4 presents the temperature difference between two surfaces, the percentage of the columnar crystals, and the average crystal grain diameter of the steel strip. Next, cold rolling was performed at a reduction ratio of 78.6%, to obtain steel sheets each having a thickness of 0.30 mm. After that, continuous finish annealing at 950° C. for 30 seconds was performed to obtain non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 4. An underline in Table 4 indicates that the underlined numeric value is out of the range of the present invention.

[Table 4]

TABLE 4

| SAMPLE No. | TEMPERATURE DIFFERENCE (° C.) | PERCENTAGE OF COLUMNAR CRYSTALS (AREA %) | AVERAGE CRYSTAL GRAIN DIAMETER OF STEEL STRIP (mm) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|
| 31 | 16 | 43 | 0.16 | 7 | 1.8 | 0.30 | 79 | COMPARATIVE EXAMPLE |
| 32 | 36 | 69 | 0.18 | 19 | 2.8 | 0.30 | 77 | COMPARATIVE EXAMPLE |
| 33 | 71 | 88 | 0.18 | 36 | 5.4 | 0.30 | 81 | INVENTION EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 5. An underline in Table 5 indicates that the underlined numeric value is not within the desired range. Specifically, an underline in a column of core loss W10/800 indicates that the underlined value is equal to or more than the evaluation criterion W0 (W/kg), and an underline in a column of magnetic flux density B50 indicates that the underlined value is less than 1.67 T.

[Table 5]

TABLE 5

| SAMPLE No. | W0 (W/kg) | W10/800 (W/kg) | B50 (T) | REMARKS |
|---|---|---|---|---|
| 31 | 44.4 | 47.2 | 1.63 | COMPARATIVE EXAMPLE |
| 32 | 44.4 | 45.6 | 1.65 | COMPARATIVE EXAMPLE |
| 33 | 44.4 | 40.5 | 1.69 | INVENTION EXAMPLE |

As presented in Table 5, in a sample No. 33 using the steel strip in which the percentage of the columnar crystals in the slab being the starting material is proper, the ratio $R_S$, the {100} crystal orientation intensity I, the thickness t, and the average crystal grain diameter r are within the range of the present invention, so that good results were obtained in the ring magnetometry.

In a sample No. 31 using the steel strip in which the percentage of the columnar crystals in the slab being the starting material is excessively low, the ratio $R_S$ and the {100} crystal orientation intensity I were excessively low, and thus the core loss W10/800 was large and the magnetic flux density B50 was low. In a sample No. 32 using the steel strip in which the percentage of the columnar crystals in the slab being the starting material is excessively low, the {100} crystal orientation intensity I was excessively low, and thus the core loss W10/800 was large and the magnetic flux density B50 was low.

(Third Test)

In a third test, molten steels having chemical compositions presented in Table 6 were cast to produce slabs, and the slabs were subjected to hot rolling to obtain steel strips each having a thickness of 1.2 mm. A balance is composed of Fe and impurities, and an underline in Table 6 indicates that the underlined numeric value is out of the range of the present invention. When performing the casting, a temperature difference between two surfaces of a cast slab was adjusted to change a percentage of columnar crystals in the slab being a starting material of the steel strip, and a starting temperature in the hot rolling and a coiling temperature were adjusted to change an average crystal grain diameter of the steel strip. The temperature difference between two surfaces was set to 53° C. to 64° C. Table 7 presents the percentage of the columnar crystals and the average crystal grain diameter of the steel strip. Next, cold rolling was performed at a reduction ratio of 79.2%, to obtain steel sheets each having a thickness of 0.25 mm. After that, continuous finish annealing at 920° C. for 45 seconds was performed to obtain non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 7. An underline in Table 7 indicates that the underlined numeric value is out of the range of the present invention.

[Table 6]

TABLE 6

| SYMBOL OF STEEL | CHEMICAL COMPOSITION (MASS % ) | | | | | | | |
|---|---|---|---|---|---|---|---|---|
| | C | Si | Al | Mn | S | Cd | TOTAL AMOUNT OF COARSE PRECIPITATE GENERATING ELEMENT | PARA-METER Q |
| U1 | 0.0025 | 3.23 | 2.51 | 0.33 | 0.0011 | 0.0012 | 0.0012 | 7.92 |
| V1 | 0.0024 | 3.20 | 2.45 | 0.36 | 0.0012 | 0.0011 | 0.0011 | 7.74 |
| W1 | 0.0022 | 3.18 | 2.43 | 0.32 | 0.0009 | 0.0002 | 0.0002 | 7.72 |
| X1 | 0.0027 | 3.27 | 2.48 | 0.37 | 0.0010 | 0.0009 | 0.0009 | 7.86 |
| Y1 | 0.0021 | 3.25 | 2.50 | 0.31 | 0.0008 | 0.0021 | 0.0021 | 7.94 |

[Table 7]

TABLE 7

| SAMPLE No. | SYMBOL OF STEEL | PERCENTAGE OF COLUMNAR CRYSTALS (AREA %) | AVERAGE CRYSTAL GRAIN DIAMETER OF STEEL STRIP (mm) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|
| 41 | U1 | 89 | 0.05 | 33 | 2.5 | 0.25 | 76 | COMPARATIVE EXAMPLE |
| 42 | V1 | 90 | 0.08 | 28 | 2.8 | 0.25 | 75 | COMPARATIVE EXAMPLE |
| 43 | W1 | 88 | 0.14 | 7 | 4.4 | 0.25 | 77 | COMPARATIVE EXAMPLE |
| 44 | X1 | 90 | 0.16 | 27 | 6.1 | 0.25 | 75 | INVENTION EXAMPLE |
| 45 | Y1 | 92 | 0.16 | 65 | 3.9 | 0.25 | 58 | COMPARATIVE EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 8. An underline in Table 8 indicates that the underlined numeric value is not within the desired range. Specifically, an underline in a column of magnetic flux density B50 indicates that the underlined value is less than 1.67 T.

[Table 8]

TABLE 8

| SAMPLE No. | W0 (W/kg) | W10/800 (W/kg) | B50 (T) | REMARKS |
|---|---|---|---|---|
| 41 | 36.7 | 31.1 | 1.60 | COMPARATIVE EXAMPLE |
| 42 | 36.7 | 28.8 | 1.63 | COMPARATIVE EXAMPLE |
| 43 | 36.7 | 33.4 | 1.65 | COMPARATIVE EXAMPLE |
| 44 | 36.7 | 27.8 | 1.68 | INVENTION EXAMPLE |
| 45 | 36.7 | 32.8 | 1.64 | COMPARATIVE EXAMPLE |

As presented in Table 8, in a sample No. 44 using the steel strip in which the chemical composition, the percentage of the columnar crystals in the slab being the starting material, and the average crystal grain diameter are proper, the ratio $R_S$, the {100} crystal orientation intensity I, the thickness t, and the average crystal grain diameter r are within the range of the present invention, so that good results were obtained in the ring magnetometry.

In a sample No. 41 and a sample No. 42 each using the steel strip whose average crystal grain diameter is excessively low, the {100} crystal orientation intensity I was excessively low, and thus the magnetic flux density B50 was low. In a sample No. 43, the total content of the coarse precipitate generating element and the ratio $R_S$ were excessively low, and thus the magnetic flux density B50 was low. In a sample No. 45, the total content of the coarse precipitate generating element was excessively high and the average crystal grain diameter r was excessively small, and thus the magnetic flux density B50 was low.

(Fourth Test)

In a fourth test, molten steels having chemical compositions presented in Table 9 were cast to produce slabs, and the slabs were subjected to hot rolling to obtain steel strips having thicknesses presented in Table 10. A blank column in Table 9 indicates that a content of an element in that column was less than a detection limit, and a balance is composed of Fe and impurities. When performing the casting, a temperature difference between two surfaces of a cast slab was adjusted to change a percentage of columnar crystals in the slab being a starting material of the steel strip, and a starting temperature in the hot rolling and a coiling temperature were adjusted to change an average crystal grain diameter of the steel strip. The temperature difference between two surfaces was set to 49° C. to 76° C. Table 10 also presents the percentage of the columnar crystals and the average crystal grain diameter of the steel strip. Next, cold rolling was performed at reduction ratios presented in Table 10, to obtain steel sheets each having a thickness of 0.20 mm. After that, continuous finish annealing at 930° C. for 40 seconds was performed to obtain non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 10. An underline in Table 10 indicates that the underlined numeric value is out of the range of the present invention.

[Table 9]

TABLE 9

| SYMBOL OF STEEL | CHEMICAL COMPOSITION (MASS %) | | | | | | | | | | |
|---|---|---|---|---|---|---|---|---|---|---|---|
| | C | Si | Al | Mn | S | Ba | Sn | Cu | Cr | TOTAL AMOUNT OF COARSE PRECIPITATE GENERATING ELEMENT | PARA-METER Q |
| Z1 | 0.0017 | 2.56 | 1.12 | 0.49 | 0.0022 | 0.0008 | | | | 0.0008 | 4.31 |
| AA1 | 0.0018 | 2.49 | 1.14 | 0.51 | 0.0019 | 0.0009 | | | | 0.0009 | 4.26 |
| BB1 | 0.0014 | 2.53 | 1.15 | 0.50 | 0.0018 | 0.0006 | 0.09 | | | 0.0006 | 4.33 |
| CC1 | 0.0016 | 2.57 | 1.09 | 0.47 | 0.0022 | 0.0007 | | 0.48 | | 0.0007 | 4.28 |
| DD1 | 0.0012 | 2.47 | 1.10 | 0.45 | 0.0020 | 0.0007 | | | 3.83 | 0.0007 | 4.22 |
| EE1 | 0.0013 | 2.52 | 1.07 | 0.56 | 0.0021 | 0.0006 | | | | 0.0006 | 4.10 |

[Table 10]

TABLE 10

| SAMPLE No. | SYMBOL OF STEEL | THICK-NESS OF STEEL STRIP (mm) | PER-CENTAGE OF COLUMNAR CRYSTALS (AREA %) | AVERAGE CRYSTAL GRAIN DIAMETER OF STEEL STRIP (mm) | RE-DUCTION RATIO (%) | RATIO $R_S$ (%) | IN-TENSITY I | THICK-NESS t (mm) | AVERAGE CRYSTAL GRAIN DIAMETER r (μm) | REMARKS |
|---|---|---|---|---|---|---|---|---|---|---|
| 51 | Z1 | 0.38 | 90 | 0.25 | 47.4 | 10 | 3.9 | 0.20 | 72 | INVENTION EXAMPLE |
| 52 | AA1 | 0.62 | 94 | 0.23 | 67.7 | 14 | 4.2 | 0.20 | 74 | INVENTION EXAMPLE |

TABLE 10-continued

| SAMPLE No. | SYMBOL OF STEEL | THICKNESS OF STEEL STRIP (mm) | PERCENTAGE OF COLUMNAR CRYSTALS (AREA %) | AVERAGE CRYSTAL GRAIN DIAMETER OF STEEL STRIP (mm) | REDUCTION RATIO (%) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|---|---|
| 53 | BB1 | 0.81 | 93 | 0.23 | 75.3 | 13 | 5.6 | 0.20 | 72 | INVENTION EXAMPLE |
| 54 | CC1 | 1.02 | 92 | 0.26 | 80.4 | 13 | 6.6 | 0.20 | 75 | INVENTION EXAMPLE |
| 55 | DD1 | 1.50 | 98 | 0.25 | 86.7 | 11 | 5.9 | 0.20 | 73 | INVENTION EXAMPLE |
| 56 | EE1 | 2.44 | 96 | 0.22 | 91.8 | 12 | 2.2 | 0.20 | 79 | COMPARATIVE EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 11. An underline in Table 11 indicates that the underlined numeric value is not within the desired range. Specifically, an underline in a column of core loss W10/800 indicates that the underlined value is equal to or more than the evaluation criterion W0 (W/kg), and an underline in a column of magnetic flux density B50 indicates that the underlined value is less than 1.67 T.

[Table 11]

TABLE 11

| SAMPLE No. | W0 (W/kg) | W10/800 (W/kg) | B50 (T) | REMARKS |
|---|---|---|---|---|
| 51 | 30.0 | 26.7 | 1.71 | INVENTION EXAMPLE |
| 52 | 30.0 | 25.3 | 1.72 | INVENTION EXAMPLE |
| 53 | 30.0 | 24.5 | 1.74 | INVENTION EXAMPLE |
| 54 | 30.0 | 23.8 | 1.74 | INVENTION EXAMPLE |
| 55 | 30.0 | 19.9 | 1.69 | INVENTION EXAMPLE |
| 56 | 30.0 | 31.6 | 1.65 | COMPARATIVE EXAMPLE |

As presented in Table 11, in each of a sample No. 51 to a sample No. 55 using the steel strip in which the chemical composition, the percentage of the columnar crystals in the slab being the starting material, and the average crystal grain diameter are proper, and on which the cold rolling was performed at a proper reduction amount, the ratio $R_S$, the {100} crystal orientation intensity I, the thickness t, and the average crystal grain diameter r are within the range of the present invention, so that good results were obtained in the ring magnetometry. In the sample No. 53 and the sample No. 54 each containing a proper amount of Sn or Cu, particularly excellent magnetic flux density B50 was obtained. In the sample No. 55 containing a proper amount of Cr, particularly excellent core loss W10/800 was obtained.

In a sample No. 56 in which the reduction ratio in the cold rolling was set to be excessively high, the {100} crystal orientation intensity I was excessively low, and thus the core loss W10/800 was large and the magnetic flux density B50 was low.

(Fifth Test)

In a fifth test, molten steels each containing, in mass %, C: 0.0014%, Si: 3.03%, Al: 0.28%, Mn: 1.42%, S: 0.0017%, and Sr: 0.0007%, and a balance composed of Fe and impurities, were cast to produce slabs, and the slabs were subjected to hot rolling to obtain steel strips each having a thickness of 0.8 mm. When performing the casting, a temperature difference between two surfaces of a cast slab was set to 61° C. to set a percentage of columnar crystals in the slab being a starting material of the steel strip to 90%, and a starting temperature in the hot rolling and a coiling temperature were adjusted to set an average crystal grain diameter of the steel strip to 0.17 mm. Next, cold rolling was performed at a reduction ratio of 81.3% to obtain steel sheets each having a thickness of 0.15 mm. After that, continuous finish annealing at 970° C. for 20 seconds was performed to obtain non-oriented electrical steel sheets. In the finish annealing, a sheet passage tension and a cooling rate between 950° C. and 700° C. were changed. Table 12 presents the sheet passage tension and the cooling rate. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 12.

[Table 12]

TABLE 12

| SAMPLE No. | SHEET PASSAGE TENSION (MPa) | COOLING RATE (° C./SECOND) | ELASTIC STRAIN ANISOTROPY (%) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|
| 61 | 4.9 | 2.4 | 1.15 | 16 | 5.1 | 0.15 | 92 | INVENTION EXAMPLE |
| 62 | 2.6 | 2.5 | 1.08 | 17 | 5.5 | 0.15 | 90 | INVENTION EXAMPLE |
| 63 | 1.9 | 2.2 | 1.05 | 17 | 5.6 | 0.15 | 90 | INVENTION EXAMPLE |
| 64 | 1.7 | 0.8 | 1.03 | 15 | 6.8 | 0.15 | 88 | INVENTION EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 13.

[Table 13]

TABLE 13

| SAMPLE No. | W0 (W/kg) | W10/800 (W/kg) | B50 (T) | REMARKS |
|---|---|---|---|---|
| 61 | 24.3 | 18.9 | 1.70 | INVENTION EXAMPLE |
| 62 | 24.3 | 18.2 | 1.72 | INVENTION EXAMPLE |
| 63 | 24.3 | 18.0 | 1.73 | INVENTION EXAMPLE |
| 64 | 24.3 | 17.6 | 1.74 | INVENTION EXAMPLE |

As presented in Table 13, in each of a sample No. 61 to a sample No. 64, the chemical composition is within the range of the present invention, and the ratio $R_S$, the {100} crystal orientation intensity I, the thickness t, and the average crystal grain diameter r are within the range of the present invention, so that good results were obtained in the ring magnetometry. In each of the sample No. 62 and the sample No. 63 in which the sheet passage tension was set to 3 MPa or less, the elastic strain anisotropy was low, and particularly excellent core loss W10/800 and magnetic flux density B50 were obtained. In the sample No. 64 in which the cooling rate between 950° C. and 700° C. was set to 1° C./second or less, the elastic strain anisotropy was further lowered, and further excellent core loss W10/800 and magnetic flux density B50 were obtained. Note that in the measurement of the elastic strain anisotropy, a sample having a quadrangular planar shape in which each side has a length of 55 mm, two sides are parallel to a rolling direction and two sides are parallel to a direction perpendicular to the rolling direction (sheet width direction), was cut out from each of the non-oriented electrical steel sheets, and the length of each side after being deformed due to the influence of the elastic strain was measured. Further, it was determined that how much larger is the length in the direction perpendicular to the rolling direction than the length in the rolling direction.

(Sixth Test)

In a sixth test, molten steels having chemical compositions presented in Table 14 were subjected to rapid solidification based on a twin-roll method to obtain steel strips. A blank column in Table 14 indicates that a content of an element in that column was less than a detection limit, and a balance is composed of Fe and impurities. An underline in Table 14 indicates that the underlined numeric value is out of the range of the present invention. Next, the steel strips were subjected to cold rolling and finish annealing to produce various non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are presented in Table 15. An underline in Table 15 indicates that the underlined numeric value is out of the range of the present invention.

[Table 14]

TABLE 14

| SYMBOL OF STEEL | CHEMICAL COMPOSITION (MASS %) | | | | | | | | | | | |
|---|---|---|---|---|---|---|---|---|---|---|---|---|
| | C | Si | Al | Mn | S | Mg | Ca | Sr | Ba | La | Zn | Cd |
| A2 | 0.0014 | 1.31 | 0.54 | 0.20 | 0.0022 | | | 0.0004 | | | | |
| B2 | 0.0013 | 2.78 | 0.90 | 0.18 | 0.0020 | | | 0.0009 | | | | |
| C2 | 0.0021 | 2.75 | 0.88 | 0.17 | 0.0019 | | | | 0.0010 | | | |
| D2 | 0.0025 | 2.77 | 0.89 | 0.18 | 0.0023 | | | | 0.0009 | | | |
| E2 | 0.0018 | 2.69 | 0.94 | 0.22 | 0.0024 | | | | | 0.0013 | | |
| F2 | 0.0019 | 2.78 | 0.90 | 0.17 | 0.0016 | | | | | | 0.0008 | |
| G2 | 0.0011 | 2.75 | 0.88 | 0.26 | 0.0035 | | 0.0008 | | | | | |
| H2 | 0.0021 | 2.72 | 0.89 | 0.21 | 0.0020 | | 0.0002 | | | | | |
| I2 | 0.0022 | 2.80 | 0.94 | 0.19 | 0.0018 | | 0.0017 | | | | | |
| J2 | 0.0020 | 1.22 | 0.89 | 1.18 | 0.0027 | 0.0007 | | | | | | |
| K2 | 0.0018 | 2.78 | 0.94 | 0.24 | 0.0022 | 0.0005 | | | | | | |
| L2 | 0.0016 | 2.75 | 0.87 | 0.21 | 0.0019 | | 0.0011 | | | | | |
| M2 | 0.0016 | 2.81 | 0.90 | 0.22 | 0.0021 | | | 0.0009 | | | | |
| N2 | 0.0020 | 2.77 | 0.89 | 0.22 | .00018 | | | | 0.0008 | | | |
| O2 | 0.0019 | 2.78 | 0.91 | 0.21 | 0.0017 | | | | | 0.0012 | | |
| P2 | 0.0017 | 2.77 | 0.94 | 0.24 | 0.0024 | | | | | | 0.0013 | |
| Q2 | 0.0021 | 2.75 | 0.92 | 0.21 | 0.0022 | | | | | | | 0.0009 |
| R2 | 0.0024 | 2.76 | 0.88 | 0.22 | 0.0015 | | | | | | | 0.0010 |
| S2 | 0.0022 | 2.83 | 0.93 | 0.24 | 0.0018 | | | | | | | 0.0007 |
| T2 | 0.0023 | 2.89 | 0.85 | 0.20 | 0.0023 | | | | | | | 0.0011 |

| CHEMICAL COMPOSITION (MASS %) | | | | |
|---|---|---|---|---|
| Sn | Cu | Cr | TOTAL AMOUNT OF COARSE PRECIPITATE GENERATING ELEMENT | Q |

TABLE 14-continued

| | | | | | |
|---|---|---|---|---|---|
| A2 | | | | 0.0004 | 2.19 |
| B2 | | | | 0.0009 | 4.40 |
| C2 | | | | 0.0010 | 4.34 |
| D2 | | | | 0.0009 | 4.37 |
| E2 | | | | 0.0013 | 4.35 |
| F2 | | | | 0.0008 | 4.41 |
| G2 | | | | 0.0008 | 4.25 |
| H2 | | | | 0.0002 | 4.29 |
| I2 | | | | 0.0017 | 4.49 |
| J2 | | | | 0.0007 | 1.82 |
| K2 | | | | 0.0005 | 4.42 |
| L2 | | | | 0.0011 | 4.28 |
| M2 | | | | 0.0009 | 4.39 |
| N2 | | | | 0.0008 | 4.33 |
| O2 | | | | 0.0012 | 4.39 |
| P2 | | | | 0.0013 | 4.41 |
| Q2 | | | | 0.0009 | 4.38 |
| R2 | 0.14 | | | 0.0010 | 4.30 |
| S2 | | 0.32 | | 0.0007 | 4.45 |
| T2 | | | 6.41 | 0.0011 | 4.39 |

[Table 15]

TABLE 15

| SAMPLE No. | SYMBOL OF STEEL | RATIO $R_S$ (%) | INTENSITY I | THICKNESS t (mm) | AVERAGE CRYSTAL GRAIN DIAMETER r (μm) | REMARKS |
|---|---|---|---|---|---|---|
| 101 | A2 | 8 | 4.6 | 0.20 | 78 | COMPARATIVE EXAMPLE |
| 102 | B2 | 18 | 2.5 | 0.20 | 79 | COMPARATIVE EXAMPLE |
| 103 | C2 | 14 | 4.8 | 0.13 | 81 | COMPARATIVE EXAMPLE |
| 104 | D2 | 11 | 4.3 | 0.32 | 80 | COMPARATIVE EXAMPLE |
| 105 | E2 | 15 | 4.5 | 0.20 | 59 | COMPARATIVE EXAMPLE |
| 106 | F2 | 22 | 4.8 | 0.20 | 108 | COMPARATIVE EXAMPLE |
| 107 | G2 | 18 | 5.0 | 0.20 | 79 | COMPARATIVE EXAMPLE |
| 108 | H2 | 7 | 4.2 | 0.20 | 78 | COMPARATIVE EXAMPLE |
| 109 | I2 | 58 | 4.4 | 0.20 | 77 | COMPARATIVE EXAMPLE |
| 110 | J2 | 35 | 4.3 | 0.20 | 88 | COMPARATIVE EXAMPLE |
| 111 | K2 | 30 | 4.1 | 0.20 | 76 | INVENTION EXAMPLE |
| 112 | L2 | 42 | 5.1 | 0.20 | 75 | INVENTION EXAMPLE |
| 113 | M2 | 18 | 4.8 | 0.20 | 77 | INVENTION EXAMPLE |
| 114 | N2 | 13 | 5.2 | 0.20 | 80 | INVENTION EXAMPLE |
| 115 | O2 | 12 | 4.3 | 0.20 | 73 | INVENTION EXAMPLE |
| 116 | P2 | 28 | 4.4 | 0.20 | 75 | INVENTION EXAMPLE |
| 117 | Q2 | 13 | 4.9 | 0.20 | 76 | INVENTION EXAMPLE |
| 118 | R2 | 22 | 4.5 | 0.20 | 78 | INVENTION EXAMPLE |
| 119 | S2 | 13 | 4.9 | 0.20 | 82 | INVENTION EXAMPLE |
| 120 | T2 | 16 | 5.1 | 0.20 | 90 | INVENTION EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 16. An underline in Table 16 indicates that the underlined numeric value is not within the desired range. Specifically, an underline in a column of core loss W10/800 indicates that the underlined value is equal to or more than an evaluation criterion W0 (W/kg) represented by an equation 2.

$$W0=30\times[0.45+0.55\times\{0.5\times(t/0.20)+0.5\times(t/0.20)^2\}] \quad \text{(Equation 2)}$$

[Table 16]

TABLE 16

| SAMPLE | W0 (W/kg) | W10/800 (W/kg) | B50 (T) | REMARKS |
|---|---|---|---|---|
| 101 | 30.0 | 34.5 | 1.74 | COMPARATIVE EXAMPLE |
| 102 | 30.0 | 32.0 | 1.67 | COMPARATIVE EXAMPLE |
| 103 | 22.3 | 25.3 | 1.67 | COMPARATIVE EXAMPLE |
| 104 | 47.8 | 49.9 | 1.71 | COMPARATIVE EXAMPLE |
| 105 | 30.0 | 33.1 | 1.69 | COMPARATIVE EXAMPLE |
| 106 | 30.0 | 31.8 | 1.68 | COMPARATIVE EXAMPLE |
| 107 | 30.0 | 34.2 | 1.68 | COMPARATIVE EXAMPLE |
| 108 | 30.0 | 37.4 | 1.67 | COMPARATIVE EXAMPLE |
| 109 | 30.0 | 35.6 | 1.68 | COMPARATIVE EXAMPLE |
| 110 | 30.0 | 33.8 | 1.71 | COMPARATIVE EXAMPLE |
| 111 | 30.0 | 24.6 | 1.72 | INVENTION EXAMPLE |
| 112 | 30.0 | 25.3 | 1.71 | INVENTION EXAMPLE |
| 113 | 30.0 | 24.2 | 1.72 | INVENTION EXAMPLE |
| 114 | 30.0 | 24.5 | 1.73 | INVENTION EXAMPLE |
| 115 | 30.0 | 23.9 | 1.72 | INVENTION EXAMPLE |
| 116 | 30.0 | 24.8 | 1.71 | INVENTION EXAMPLE |
| 117 | 30.0 | 24.1 | 1.71 | INVENTION EXAMPLE |
| 118 | 30.0 | 23.4 | 1.73 | INVENTION EXAMPLE |
| 119 | 30.0 | 22.9 | 1.73 | INVENTION EXAMPLE |
| 120 | 30.0 | 17.6 | 1.68 | INVENTION EXAMPLE |

As presented in Table 16, in each of a sample No. 111 to a sample No. 120, the chemical composition is within the range of the present invention, and the ratio $R_S$, the {100} crystal orientation intensity I, the thickness t, and the average crystal grain diameter r are within the range of the present invention, so that good results were obtained in the ring magnetometry.

In the sample No. 101, the ratio $R_S$ was excessively low, and thus the core loss W10/800 was large. In the sample No. 102, the {100} crystal orientation intensity I was excessively low, and thus the core loss W10/800 was large. In the sample No. 103, the thickness t was excessively small, and thus the core loss W10/800 was large. In the sample No. 104, the thickness t was excessively large, and thus the core loss W10/800 was large. In the sample No. 105, the average crystal grain diameter r was excessively small, and thus the core loss W10/800 was large. In the sample No. 106, the average crystal grain diameter r was excessively large, and thus the core loss W10/800 was large. In the sample No. 107, the S content was excessively high, and thus the core loss W10/800 was large. In the sample No. 108, the total content of the coarse precipitate generating element was excessively low, and thus the core loss W10/800 was large. In the sample No. 109, the total content of the coarse precipitate generating element was excessively high, and thus the core loss W10/800 was large. In the sample No. 110, the parameter Q was excessively small, and thus the core loss W10/800 was large.

(Seventh Test)

In a seventh test, molten steels each containing, in mass %, C: 0.0023%, Si: 3.46%, Al: 0.63%, Mn: 0.20%, S: 0.0003%, and Nd: 0.0008%, and a balance composed of Fe and impurities, were subjected to rapid solidification based on a twin-roll method to obtain steel strips each having a thickness of 1.4 mm. At this time, a pouring temperature was adjusted to change a percentage of columnar crystals and an average crystal grain diameter of each of the steel strips. Table 17 presents a difference between the pouring temperature and a solidification temperature, the percentage of the columnar crystals, and the average crystal grain diameter of the steel strip. Next, cold rolling was performed at a reduction ratio of 78.6%, to obtain steel sheets each having a thickness of 0.30 mm. After that, continuous finish annealing at 950° C. for 30 seconds was performed to obtain non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 17. An underline in Table 17 indicates that the underlined numeric value is out of the range of the present invention.

[Table 17]

TABLE 17

| SAMPLE No. | TEMPERATURE DIFFERENCE (° C.) | PERCENTAGE OF COLUMNAR CRYSTALS (AREA %) | AVERAGE CRYSTAL GRAIN DIAMETER OF STEEL STRIP (mm) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|
| 131 | 13 | 43 | 0.16 | 7 | 1.8 | 0.30 | 79 | COMPARATIVE EXAMPLE |
| 132 | 21 | 69 | 0.18 | 19 | 2.8 | 0.30 | 77 | COMPARATIVE EXAMPLE |
| 133 | 28 | 88 | 0.18 | 36 | 5.4 | 0.30 | 81 | INVENTION EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 18. An underline in Table 18 indicates that the underlined numeric value is not within the desired range. Specifically, an underline in a column of core loss W10/800 indicates that the underlined value is equal to or more than the evaluation criterion W0 (W/kg), and an underline in a column of magnetic flux density B50 indicates that the underlined value is less than 1.67 T.

[Table 18]

TABLE 18

| SAMPLE No. | W0 (W/kg) | W10/800 (W/kg) | B50 (T) | REMARKS |
|---|---|---|---|---|
| 131 | 44.4 | 47.2 | 1.63 | COMPARATIVE EXAMPLE |
| 132 | 44.4 | 45.6 | 1.65 | COMPARATIVE EXAMPLE |
| 133 | 44.4 | 40.5 | 1.69 | INVENTION EXAMPLE |

As presented in Table 18, in a sample No. 133 using the steel strip in which the percentage of the columnar crystals is proper, the ratio $R_S$, the {100} crystal orientation intensity I, the thickness t, and the average crystal grain diameter r are within the range of the present invention, so that good results were obtained in the ring magnetometry.

In a sample No. 131 using the steel strip in which the percentage of the columnar crystals is excessively low, the ratio $R_S$ and the {100} crystal orientation intensity I were excessively low, and thus the core loss W10/800 was large and the magnetic flux density B50 was low. In a sample No. 132 using the steel strip in which the percentage of the columnar crystals is excessively low, the {100} crystal orientation intensity I was excessively low, and thus the core loss W10/800 was large and the magnetic flux density B50 was low.

(Eighth Test)

In an eighth test, molten steels having chemical compositions presented in Table 19 were subjected to rapid solidification based on a twin-roll method to obtain steel strips each having a thickness of 1.2 mm. A balance is composed of Fe and impurities, and an underline in Table 19 indicates that the underlined numeric value is out of the range of the present invention. At this time, a pouring temperature was adjusted to change a percentage of columnar crystals and an average crystal grain diameter of each of the steel strips. The pouring temperature was set to be higher than a solidification temperature by 29° C. to 35° C. Table 20 presents the percentage of the columnar crystals and the average crystal grain diameter of the steel strip. Next, cold rolling was performed at a reduction ratio of 79.2%, to obtain steel sheets each having a thickness of 0.25 mm. After that, continuous finish annealing at 920° C. for 45 seconds was performed to obtain non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 20. An underline in Table 20 indicates that the underlined numeric value is out of the range of the present invention.

[Table 19]

TABLE 19

| SYMBOL OF STEEL | CHEMICAL COMPOSITION (MASS %) C | Si | Al | Mn | S | Cd | TOTAL AMOUNT OF COARSE PRECIPITATE GENERATING ELEMENT | PARAMETER Q |
|---|---|---|---|---|---|---|---|---|
| U2 | 0.0025 | 3.23 | 2.51 | 0.33 | 0.0011 | 0.0012 | 0.0012 | 7.92 |
| V2 | 0.0024 | 3.20 | 2.45 | 0.36 | 0.0012 | 0.0011 | 0.0011 | 7.74 |
| W2 | 0.0022 | 3.18 | 2.43 | 0.32 | 0.0009 | 0.0002 | 0.0002 | 7.72 |
| X2 | 0.0027 | 3.27 | 2.48 | 0.37 | 0.0010 | 0.0009 | 0.0009 | 7.86 |
| Y2 | 0.0021 | 3.25 | 2.50 | 0.31 | 0.0008 | 0.0021 | 0.0021 | 7.94 |

[Table 20]

TABLE 20

| SAMPLE No. | SYMBOL OF STEEL | PERCENTAGE OF COLUMNAR CRYSTALS (AREA %) | AVERAGE CRYSTAL GRAIN DIAMETER OF STEEL STRIP (mm) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|
| 141 | U2 | 89 | 0.05 | 33 | 2.5 | 0.25 | 76 | COMPARATIVE EXAMPLE |
| 142 | V2 | 90 | 0.08 | 28 | 2.8 | 0.25 | 75 | COMPARATIVE EXAMPLE |
| 143 | W2 | 88 | 0.14 | 7 | 4.4 | 0.25 | 77 | COMPARATIVE EXAMPLE |
| 144 | X2 | 90 | 0.16 | 27 | 6.1 | 0.25 | 75 | INVENTION EXAMPLE |
| 145 | Y2 | 92 | 0.16 | 65 | 3.9 | 0.25 | 58 | COMPARATIVE EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 21. An underline in Table 21 indicates that the underlined numeric value is not within the desired range. Specifically, an underline in a column of magnetic flux density B50 indicates that the underlined value is less than 1.67 T.

[Table 21]

TABLE 21

| SAMPLE No. | W0 (W/kg) | W10/800 (W/kg) | B50 (T) | REMARKS |
|---|---|---|---|---|
| 141 | 36.7 | 31.1 | 1.60 | COMPARATIVE EXAMPLE |
| 142 | 36.7 | 28.8 | 1.63 | COMPARATIVE EXAMPLE |
| 143 | 36.7 | 33.4 | 1.65 | COMPARATIVE EXAMPLE |
| 144 | 36.7 | 27.8 | 1.68 | INVENTION EXAMPLE |
| 145 | 36.7 | 32.8 | 1.64 | COMPARATIVE EXAMPLE |

As presented in Table 21, in a sample No. 144 using the steel strip in which the chemical composition, the percentage of the columnar crystals, and the average crystal grain diameter are proper, the ratio $R_S$, the {100} crystal orientation intensity I, the thickness t, and the average crystal grain diameter r are within the range of the present invention, so that good results were obtained in the ring magnetometry.

In a sample No. 141 and a sample No. 142 each using the steel strip in which the average crystal grain diameter is excessively low, the {100} crystal orientation intensity I was excessively low, and thus the magnetic flux density B50 was low. In a sample No. 143, the total content of the coarse precipitate generating element and the ratio $R_S$ were excessively low, and thus the magnetic flux density B50 was low. In a sample No. 145, the total content of the coarse precipitate generating element was excessively high and the average crystal grain diameter r was excessively small, and thus the magnetic flux density B50 was low.

(Ninth Test)

In a ninth test, molten steels having chemical compositions presented in Table 22 were subjected to rapid solidification based on a twin-roll method to obtain steel strips having thicknesses presented in Table 23. A blank column in Table 22 indicates that a content of an element in that column was less than a detection limit, and a balance is composed of Fe and impurities. At this time, a pouring temperature was adjusted to change a percentage of columnar crystals and an average crystal grain diameter of each of the steel strips. The pouring temperature was set to be higher than a solidification temperature by 28° C. to 37° C. Table 23 also presents the percentage of the columnar crystals and the average crystal grain diameter of the steel strip. Next, cold rolling was performed at reduction ratios presented in Table 23, to obtain steel sheets each having a thickness of 0.20 mm. After that, continuous finish annealing at 930° C. for 40 seconds was performed to obtain non-oriented electrical steel sheets. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 23. An underline in Table 23 indicates that the underlined numeric value is out of the range of the present invention.

[Table 22]

TABLE 22

| SYMBOL OF STEEL | CHEMICAL COMPOSITION (MASS %) | | | | | | | | | | |
|---|---|---|---|---|---|---|---|---|---|---|---|
| | C | Si | Al | Mn | S | Ba | Sn | Cu | Cr | TOTAL AMOUNT OF COARSE PRECIPITATE GENERATING ELEMENT | PARAMETER Q |
| Z2 | 0.0017 | 2.56 | 1.12 | 0.49 | 0.0022 | 0.0008 | | | | 0.0008 | 4.31 |
| AA2 | 0.0018 | 2.49 | 1.14 | 0.51 | 0.0019 | 0.0009 | | | | 0.0009 | 4.26 |
| BB2 | 0.0014 | 2.53 | 1.15 | 0.50 | 0.0018 | 0.0006 | 0.09 | | | 0.0006 | 4.33 |
| CC2 | 0.0016 | 2.57 | 1.09 | 0.47 | 0.0022 | 0.0007 | | 0.48 | | 0.0007 | 4.28 |
| DD2 | 0.0012 | 2.47 | 1.10 | 0.45 | 0.0020 | 0.0007 | | | 3.83 | 0.0007 | 4.22 |
| EE2 | 0.0013 | 2.52 | 1.07 | 0.56 | 0.0021 | 0.0006 | | | | 0.0006 | 4.10 |

[Table 23]

TABLE 23

| SAMPLE No. | SYMBOL OF STEEL | THICKNESS OF STEEL STRIP (mm) | PERCENTAGE OF COLUMNAR CRYSTALS (AREA %) | AVERAGE CRYSTAL GRAIN DIAMETER OF STEEL STRIP (mm) | REDUCTION RATIO (%) | RATIO $R_S$ (%) | INTENSITY I | THICKNESS t (mm) | AVERAGE CRYSTAL GRAIN DIAMETER (μm) | REMARKS |
|---|---|---|---|---|---|---|---|---|---|---|
| 151 | Z2 | 0.38 | 90 | 0.25 | 47.4 | 10 | 3.9 | 0.20 | 72 | INVENTION EXAMPLE |
| 152 | AA2 | 0.62 | 94 | 0.23 | 67.7 | 14 | 4.2 | 0.20 | 74 | INVENTION EXAMPLE |
| 153 | BB2 | 0.81 | 93 | 0.23 | 75.3 | 13 | 5.6 | 0.20 | 72 | INVENTION EXAMPLE |

TABLE 23-continued

| SAMPLE No. | SYMBOL OF STEEL | THICKNESS OF STEEL STRIP (mm) | PERCENTAGE OF COLUMNAR CRYSTALS (AREA %) | AVERAGE CRYSTAL GRAIN DIAMETER OF STEEL STRIP (mm) | REDUCTION RATIO (%) | RATIO $R_S$ (%) | INTENSITY I | THICKNESS t (mm) | AVERAGE CRYSTAL GRAIN DIAMETER (μm) | REMARKS |
|---|---|---|---|---|---|---|---|---|---|---|
| 154 | CC2 | 1.02 | 92 | 0.26 | 80.4 | 13 | 6.6 | 0.20 | 75 | INVENTION EXAMPLE |
| 155 | DD2 | 1.50 | 98 | 0.25 | 86.7 | 11 | 5.9 | 0.20 | 73 | INVENTION EXAMPLE |
| 156 | EE2 | 2.44 | 96 | 0.22 | 91.8 | 12 | 2.2 | 0.20 | 79 | COMPARATIVE EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 24. An underline in Table 24 indicates that the underlined numeric value is not within the desired range. Specifically, an underline in a column of core loss W10/800 indicates that the underlined value is equal to or more than the evaluation criterion W0 (W/kg), and an underline in a column of magnetic flux density B50 indicates that the underlined value is less than 1.67 T.

[Table 24]

TABLE 24

| SAMPLE No. | W0 (W/kg) | W10/800 (W/kg) | B50 (T) | REMARKS |
|---|---|---|---|---|
| 151 | 30.0 | 26.7 | 1.71 | INVENTION EXAMPLE |
| 152 | 30.0 | 25.3 | 1.72 | INVENTION EXAMPLE |
| 153 | 30.0 | 24.5 | 1.74 | INVENTION EXAMPLE |
| 154 | 30.0 | 23.8 | 1.74 | INVENTION EXAMPLE |
| 155 | 30.0 | 19.9 | 1.69 | INVENTION EXAMPLE |
| 156 | 30.0 | 31.6 | 1.65 | COMPARATIVE EXAMPLE |

As presented in Table 24, in each of a sample No. 151 to a sample No. 155 using the steel strip in which the chemical composition, the percentage of the columnar crystals, and the average crystal grain diameter are proper, and on which the cold rolling was performed at a proper reduction amount, the ratio $R_S$, the {100} crystal orientation intensity I, the thickness t, and the average crystal grain diameter r are within the range of the present invention, so that good results were obtained in the ring magnetometry. In the sample No. 153 and the sample No. 154 each containing a proper amount of Sn or Cu, particularly excellent magnetic flux density B50 was obtained. In the sample No. 155 containing a proper amount of Cr, particularly excellent core loss W10/800 was obtained.

In a sample No. 156 in which the reduction ratio in the cold rolling was set to be excessively high, the {100} crystal orientation intensity I was excessively low, and thus the core loss W10/800 was large and the magnetic flux density B50 was low.

(Tenth Test)

In a tenth test, molten steels each containing, in mass %, C: 0.0014%, Si: 3.03%, Al: 0.28%, Mn: 1.42%, S: 0.0017%, and Sr: 0.0007%, and a balance composed of Fe and impurities, were subjected to rapid solidification based on a twin-roll method to obtain steel strips each having a thickness of 0.8 mm. At this time, a pouring temperature was set to be higher than a solidification temperature by 32° C. to set a percentage of columnar crystals of the steel strip to 90% and set an average crystal grain diameter to 0.17 mm. Next, cold rolling was performed at a reduction ratio of 81.3% to obtain steel sheets each having a thickness of 0.15 mm. After that, continuous finish annealing at 970° C. for 20 seconds was performed to obtain non-oriented electrical steel sheets. In the finish annealing, a sheet passage tension and a cooling rate between 950° C. and 700° C. were changed. Table 25 presents the sheet passage tension and the cooling rate. Subsequently, in each of the non-oriented electrical steel sheets, a ratio $R_S$ of the total mass of S contained in sulfides or oxysulfides of the coarse precipitate generating element to the total mass of S contained in the non-oriented electrical steel sheet, a {100} crystal orientation intensity I, a thickness t, and an average crystal grain diameter r were measured. Results thereof are also presented in Table 25.

[Table 25]

TABLE 25

| SAMPLE No. | SHEET PASSAGE TENSION (MPa) | COOLING RATE (° C./SECOND) | ELASTIC STRAIN ANISOTROPY (%) | RATIO $R_S$ (%) | INTENSITY I | THICKNESS t (mm) | AVERAGE CRYSTAL GRAIN DIAMETER r (μm) | REMARKS |
|---|---|---|---|---|---|---|---|---|
| 161 | 4.9 | 2.4 | 1.15 | 16 | 5.1 | 0.15 | 92 | INVENTION EXAMPLE |
| 162 | 2.6 | 2.5 | 1.08 | 17 | 5.5 | 0.15 | 90 | INVENTION EXAMPLE |
| 163 | 1.9 | 2.2 | 1.05 | 17 | 5.6 | 0.15 | 90 | INVENTION EXAMPLE |
| 164 | 1.7 | 0.8 | 1.03 | 15 | 6.8 | 0.15 | 88 | INVENTION EXAMPLE |

Further, magnetic properties of each of the non-oriented electrical steel sheets were measured. In this measurement, a ring test piece having an outside diameter of 5 inches and an inside diameter of 4 inches was used. Specifically, ring magnetometry was conducted. Results thereof are presented in Table 26.

[Table 26]

TABLE 26

| SAMPLE No. | W0 (W/kg) | W10/800 (W/kg) | B50 (T) | REMARKS |
|---|---|---|---|---|
| 161 | 24.3 | 18.9 | 1.70 | INVENTION EXAMPLE |
| 162 | 24.3 | 18.2 | 1.72 | INVENTION EXAMPLE |
| 163 | 24.3 | 18.0 | 1.73 | INVENTION EXAMPLE |
| 164 | 24.3 | 17.6 | 1.74 | INVENTION EXAMPLE |

As presented in Table 26, in each of a sample No. 161 to a sample No. 164, the chemical composition is within the range of the present invention, and the ratio $R_S$, the {100} crystal orientation intensity I, the thickness t, and the average crystal grain diameter r are within the range of the present invention, so that good results were obtained in the ring magnetometry. In each of the sample No. 162 and the sample No. 163 in which the sheet passage tension was set to 3 MPa or less, the elastic strain anisotropy was low, and particularly excellent core loss W10/800 and magnetic flux density B50 were obtained. In the sample No. 164 in which the cooling rate between 950° C. and 700° C. was set to 1° C./second or less, the elastic strain anisotropy was further lowered, and further excellent core loss W10/800 and magnetic flux density B50 were obtained. Note that in the measurement of the elastic strain anisotropy, a sample having a quadrangular planar shape in which each side has a length of 55 mm, two sides are parallel to a rolling direction and two sides are parallel to a direction perpendicular to the rolling direction (sheet width direction), was cut out from each of the non-oriented electrical steel sheets, and the length of each side after being deformed due to the influence of the elastic strain was measured. Further, it was determined that how much larger is the length in the direction perpendicular to the rolling direction than the length in the rolling direction.

INDUSTRIAL APPLICABILITY

The present invention can be utilized for an industry of manufacturing a non-oriented electrical steel sheet and an industry of utilizing a non-oriented electrical steel sheet, for example.

The invention claimed is:

1. A non-oriented electrical steel sheet, comprising a chemical composition represented by:

in mass %,

C: 0.0030% or less;

Si: 2.00% to 4.00%;

Al: 0.10% to 3.00%;

Mn: 0.10% to 2.00%;

S: 0.0030% or less;

one kind or more selected from a group consisting of Mg, Sr, Ba, Ce, La, Nd, Pr, Zn, and Cd: 0.0003% or more and less than 0.0015% in total;

a parameter Q represented by an equation 1 when the Si content (mass %) is set to [Si], the Al content (mass %) is set to [Al], and the Mn content (mass %) is set to [Mn]: 2.00 or more;

Sn: 0.00% to 0.40%;

Cu: 0.0% to 1.0%;

Cr: 0.0% to 10.0%; and a balance: Fe and impurities, wherein:

the total mass of S contained in sulfides or oxysulfides of Mg, Sr, Ba, Ce, La, Nd, Pr, Zn, or Cd is 10% or more of the total mass of S contained in the non-oriented electrical steel sheet;

a {100} crystal orientation intensity is 3.0 or more;

a thickness is 0.15 mm to 0.30 mm; and an average crystal grain diameter is 65 μm to 100 μm, $$Q=[Si]+2[Al]-[Mn] \quad \text{(Equation 1).}$$

2. The non-oriented electrical steel sheet according to claim 1, wherein in the chemical composition, Sn: 0.02% to 0.40% or Cu: 0.1% to 1.0% is satisfied, or both of them are satisfied.

3. The non-oriented electrical steel sheet according to claim 1, wherein in the chemical composition, Cr: 0.2% to 10.0% is satisfied.

4. The non-oriented electrical steel sheet according to claim 2, wherein in the chemical composition, Cr: 0.2% to 10.0% is satisfied.

* * * * *